US005404932A

United States Patent [19]

Koivisto et al.

[11] Patent Number: 5,404,932

[45] Date of Patent: Apr. 11, 1995

[54] APPARATUS AND METHOD FOR INTENSIFYING COOLING IN THE CASTING OF METAL OBJECTS

[75] Inventors: Markku H. Koivisto; Seppo I. Pietilä, both of Pori, Finland

[73] Assignee: Outokumpu Castform Oy, Espoo, Finland

[21] Appl. No.: 94,762

[22] Filed: Jul. 20, 1993

Related U.S. Application Data

[63] Continuation-in-part of Ser. No. 778,308, Oct. 16, 1991, abandoned.

[30] Foreign Application Priority Data

Oct. 17, 1990 [FI] Finland ..... 905102

[51] Int. Cl.[6] ..... B22D 11/124

[52] U.S. Cl. ..... 164/443; 164/348; 164/485

[58] Field of Search ..... 164/443, 485, 444, 418, 164/486, 487, 439, 484, 348

[56] References Cited

U.S. PATENT DOCUMENTS 3,872,913 3/1975 Lohikoski .
5,244,034 9/1993 Vamada ..... 164/443

FOREIGN PATENT DOCUMENTS 194090 3/1957 Austria .
77861 11/1967 Denmark .
68180 7/1982 Finland .
74415 7/1987 Finland .
0197352 8/1990 Japan ..... 164/443
556887 5/1977 U.S.S.R. .
667322 6/1979 U.S.S.R. .
952422 8/1982 U.S.S.R. .

*Primary Examiner*—P. Austin Bradley
*Assistant Examiner*—James Miner
*Attorney, Agent, or Firm*—Smith-Hill and Bedell

[57] ABSTRACT

An apparatus for continuous upward casting of a metal object comprises a nozzle having an upper part, a cooler surrounding the upper part of the nozzle and defining a cooling chamber for receiving a flow of cooling agent, a separating element dividing the cooling chamber into an inner part and an outer part. A guide structure is formed in the cooler near the bottom of the cooler, for influencing flow of cooling agent and intensifying cooling of the metal object near the bottom of the cooler, whereby a solidification front is formed in the nozzle between molten metal and solid metal near the bottom of the cooler.

4 Claims, 5 Drawing Sheets

18
13
14
17a
11
17
16
15
12

27
23
24
22
26
21
25

38
33
34
31
36
37
35
32

APPARATUS AND METHOD FOR INTENSIFYING COOLING IN THE CASTING OF METAL OBJECTS

CROSS-REFERENCE TO RELATED APPLICATION

This is a continuation-in-part of application Ser. No. 07/778,308, filed Oct. 16, 1991, now abandoned.

BACKGROUND OF THE INVENTION

This invention relates to an apparatus and method for intensifying cooling in the casting of metal objects, particularly in essentially vertical continuous casting carried out from bottom to top.

In continuous upward casting of a metal object, known for example from U.S. Pat. No. 3,746,077, the molten metal is drawn upwardly into a graphite nozzle where it is cooled, for example, by using a cooler 3 as shown in FIG. 1. The cooler 3 comprises a body of metal, such as copper, defining a vertical bore that contains the nozzle 1. The cooler 3 is surrounded by a jacket of thermal insulation material and is positioned relative to the melt so that the lower end of the nozzle 1 and the bottom part of the cooler 3 are below the free surface of the melt. A cooling agent, typically water, is conducted into the top of the cooler, via an inlet located in the vicinity of the outer wall of the cooler and flows downwards in an outer passage between the outer wall of the cooler and an intermediate pipe 4. From the bottom of the intermediate pipe the cooling agent is directed upwards in an inner passage towards an outlet while flowing in contact with the inner wall of the cooler and is discharged from the top of the cooler. A solidification front 2, where the molten metal turns solid, is formed near the bottom of the nozzle. The solidification front extends over a height H, from a level L1 to a level L2. It is apparent that the rate of removal of thermal energy from the nozzle 1 is at its highest essentially at the level of the solidification front 2, as shown in FIG. 1 by the arrows 5, because the metal, in the course of solidification, changes state and thus emits latent heat.

The cooler shown in FIG. 1 operates satisfactorily at relatively low casting speeds, because the thermal capacity of the cooler itself contributes substantially to removal of heat from the molten metal.

When using the prior art cooler shown in FIG. 1 for instance in the casting of wire, the casting is carried out at essentially high velocities. At the higher rate at which melt enters the nozzle, the flow of cooling agent is unable to remove heat from the cooler as fully as when the casting speed is lower, so that the temperature of the cooler is higher than when the cooler is operated at lower casting speeds. The increase in temperature of the cooler may lead to thermal expansion of the lower part of the cooler, which creates a gap in the threading between the nozzle and the cooler and leads to loss in efficiency in removal of heat from the nozzle. Moreover, the increase in the temperature of the cooler may result in an insulating steam bed being formed in the cooling agent, causing further loss in cooling efficiency. Therefore, the distance over which the metal entering the nozzle must pass in order for sufficient heat to be extracted for solidification to take place increases, with the result that the solidification front moves upwards and the height of the solidification front increases, as shown in FIG. 1A. The temperature of the cast object leaving the nozzle is substantially higher than when an object is cast at low speed While casting for instance copper wire at the rate of 6 m/min, the surface temperature of the wire may, after cooling, be over 500° C. Such a high wire temperature may cause the wire to break off during casting so that the casting is interrupted and must be re-started. Restarting the casting operation is time consuming, so the rate of production of wire is reduced. Furthermore, if the wire breaks off during casting, the nozzle may be damaged, so that the re-starting may also involve replacement of the nozzle, adding to the cost of operation. If the length of wire that has been cast before the break occurred is quite short, it might not be usable and therefore have to be sent to remelt.

It is desirable that the height of the solidification front-be small and that the solidification front be formed near the bottom of the cooler, so that the cast object continues to be cooled by the action of the cooler over substantially the entire length of the nozzle that is within the cooler body.

SUMMARY OF THE INVENTION

The object of the present invention is to eliminate some of the drawbacks of the prior art and to achieve a new, improved apparatus, which is more secure in operation, so that the cooling, particularly in continuous vertical upward casting, is made efficient also at essentially high casting velocities.

According to the invention, the flow path of the cooling agent, flowing in the cooler of a continuous upward casting machine, is changed by means of at least one guide member, particularly at the level of the solidification front, so that the cooling, particularly at this level at least, is advantageously intensified. At the same time, this prevents creation of an insulating steam bed, so that the temperature of the cast object does not rise unduly and the danger of the object being broken off during casting is reduced.

The guide member or members of the invention can advantageously be placed in the housing of the cooler, and/or in a separating member defining the flow direction of the cooling agent, which enables the flow of the cooling agent first from the top part of the cooler down to the bottom, and then back up to the top of the cooler. When placing the guide member or members in the cooler housing, these members form channels for guiding the cooling agent to essentially near the surface to be cooled. Thus the cooling can be intensified, also and essentially as regards the section located above the level of the solidification front.

In order to install the guide member of the present invention in the separating member of the cooling agent, the bottom part of the separating member can be provided with the guide member, for directing the cooling agent in an advantageous fashion towards the surface of the cooler located essentially at the level of the solidification front. For an advantageous aligning of the cooling agent, it is also possible to arrange a groove in the cooler, essentially at the level of the solidification front, which groove advantageously expands the cooling surface at this most critical point.

By employing the guide member or members of the invention, the cooling agent is advantageously made to flow past the most critical point as regards vertical continuous casting, so that essentially the total cooling capacity of the cooling agent can be made use of. Thus, it is possible to increase casting velocities from the current state without causing an increase in the temperature of the cast product and a consequent danger of breaking.

BRIEF DESCRIPTION OF THE DRAWINGS

In the following the invention is explained in more detail with reference to the appended drawings, where.

DETAILED DESCRIPTION

Figure 1:
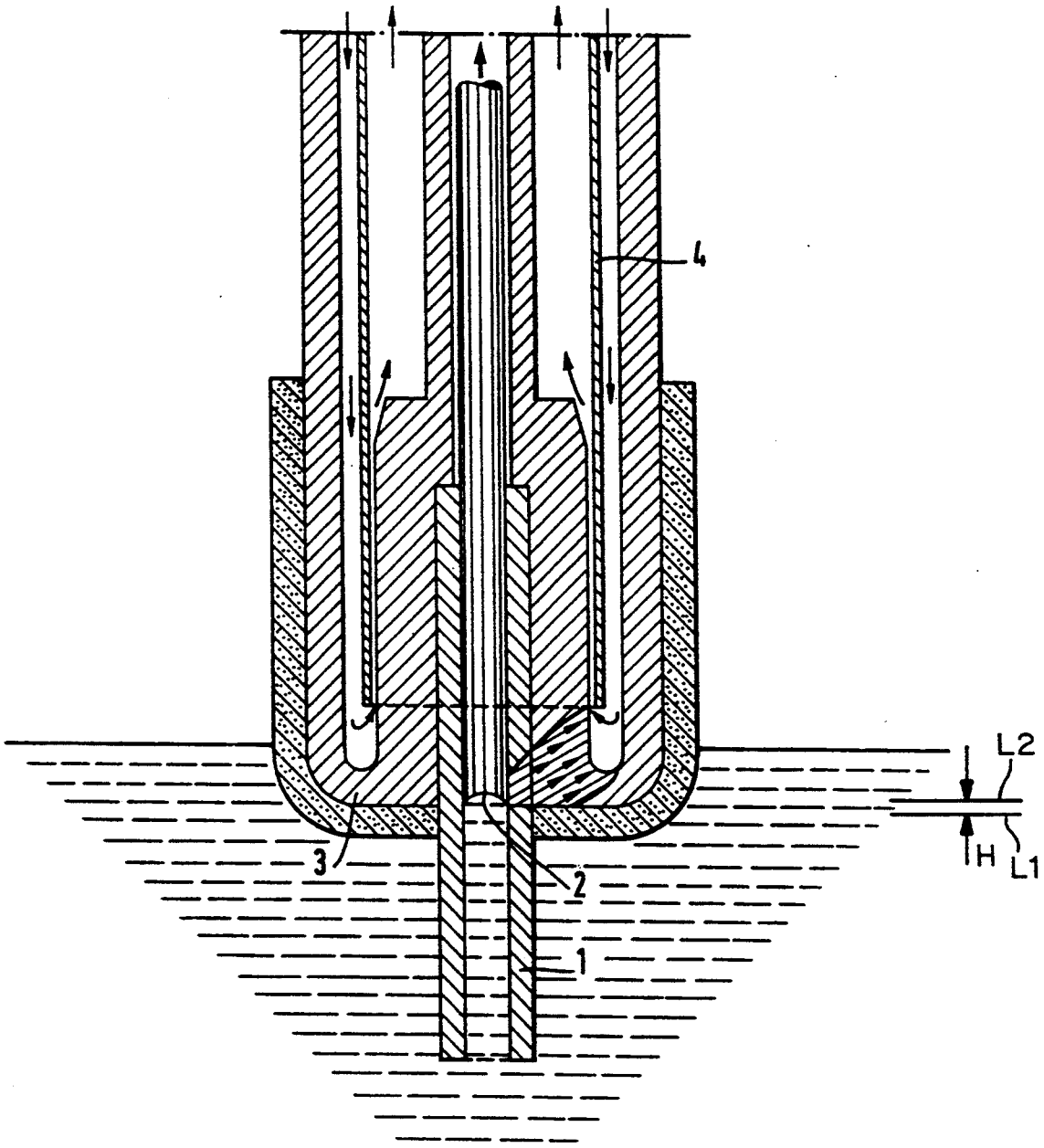
Fig. 1 PRIOR ART
FIG. 1 is a vertical sectional view of a prior art cooler of a casting machine applying continuous upward casting.
Figure 1A:
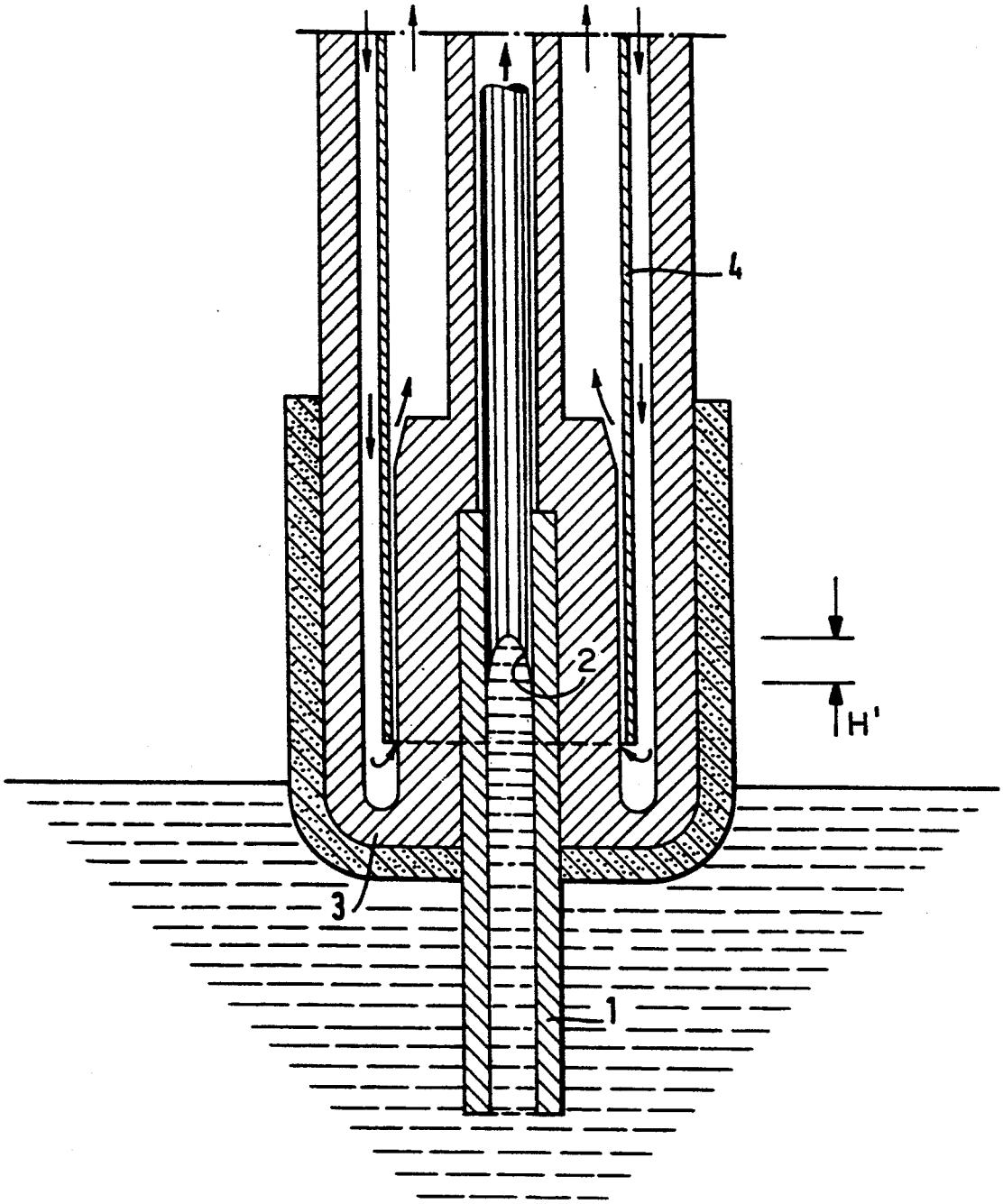
Fig. 1A PRIOR ART
FIG. 1A shows the cooler of FIG. 1 when used for casting at higher velocities.
Figure 2:
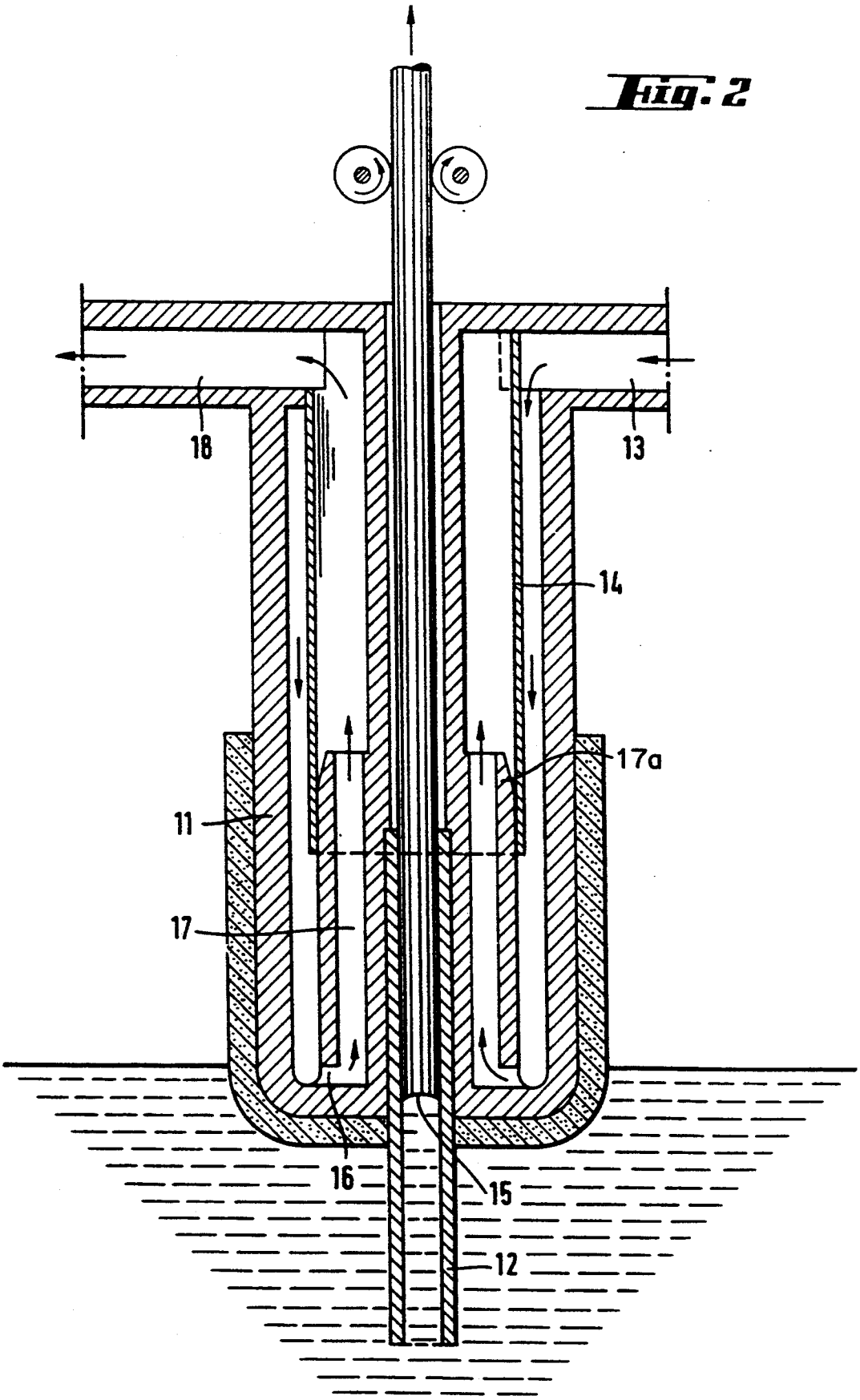
FIG. 2 is a vertical sectional view of a first embodiment of the invention, where the guide member of the cooling agent is located in the cooler housing.

In FIG. 2, the cooler 11 is arranged around the nozzle 12, so that at least the top part of the nozzle 12 is cooled. The cooling agent, such as water, is brought into the cooler 11 through inlet 13 located at the top end of the cooler. In the cooler 11, the cooling agent flows, in the direction of the arrows of FIG. 2, first downwards in the space between the outer wall of the cooler 11 and the separating member 14 arranged inside the cooler. Thereafter the cooling agent is conducted, according to the invention, downwardly between the inner and outer walls of the cooler body approximately to the desired level of the solidification front 15 in the nozzle 12, and then passes through an essentially horizontal guide channel 16 provided in the cooler body, so that the cooling agent flows to essentially near to the inner surface of the cooler 11. Consequently the horizontal flow of cooling agent meets the inner wall of the cooler 11 essentially at the hottest point, which advantageously improves the efficiency of the cooling. The guide channel 16 is further connected to another guide channel 17, which is essentially parallel to the vertical inner wall of the cooler 11. In addition to the fact that the guide channels 16 and 17 bring the cooling agent essentially nearer to the hottest point of the cooler housing, the surface area of the cooler housing 11 that is in contact with the cooling agent is also essentially enlarged at the hottest point. This brings about a further substantial improvement in the cooling power of the cooler 11.

Through the guide channel 17, the heated cooling agent rises in the space between the inner wall of the cooler 11 and the separating member 14, to be discharged from the cooler 11 via the outlet 18. The number of guide channels 16 and 17 in one cooler 11 may vary depending on the use of the apparatus of the invention, so that for example, there may be a single continuous guide channel connecting with a single annular channel 17, or there may be several discrete guide channels 16 distributed about the cooler and connecting with respective channels 17. Naturally, the portion 17*a* of the cooler must be properly supported relative to the rest of the cooler.

Figure 3:
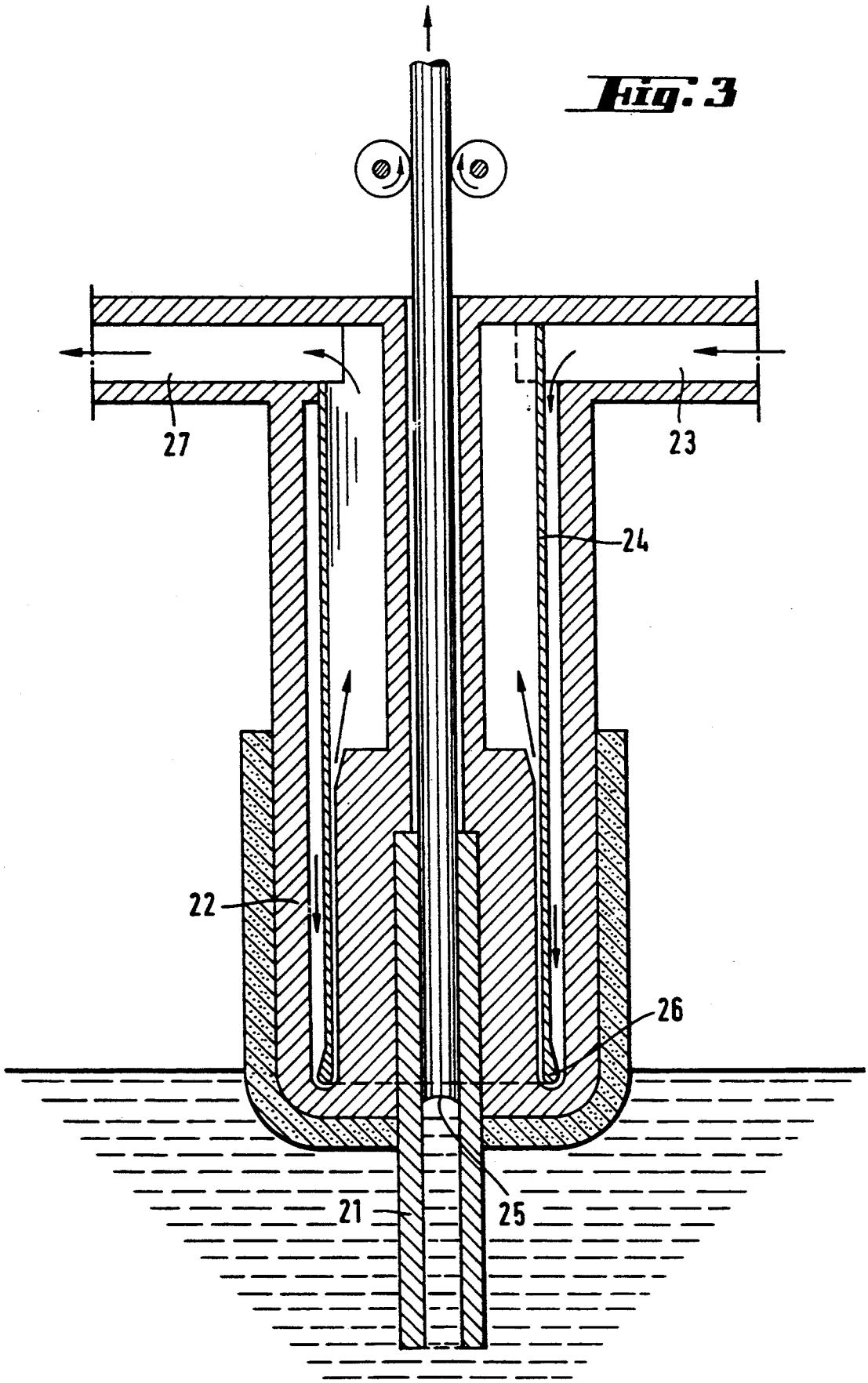
FIG. 3 is a vertical sectional view of a second embodiment of the invention, where the guide member of the cooling agent is located in-the separating member.

In FIG. 3, around the nozzle 21 there is arranged the cooler 22, where the flowing direction of the cooling agent is indicated with arrows in similar fashion to FIG. 2. The cooling agent is fed into the cooler 22 through the inlet 23, and the cooling agent flows, in the space between the outer wall of the cooler 11 and the separating member 24, to the bottom part of the cooler. According to the invention, the bottom part of the separating member 24, essentially at the desired level of the solidification front 25, is provided with at least one guide or aligning member 26 for guiding the cooling agent towards the inner wall of the cooler, advantageously at the point in the wall which requires most intensive cooling. The heated cooling agent is conducted onwards, through a flow space formed between the separating member 24 and the inner wall of the cooler, to the outlet 27. It will be noted that the configuration of the guide member 26 is such that the fluid supply passage becomes narrower in the downward direction, so that the flow speed increases. It will also be seen that the fluid return passage has a smaller cross sectional area than the fluid supply passage, so that the flow speed is higher in the return passage than in the supply passage. By employing the guide member 26 of the invention, a higher flow rate and thus a better cooling capacity is obtained for the cooling agent. Likewise, the turbulence of the cooling agent is increased, so that the creation of a steam bed on the cooler surface is advantageously prevented.

Figure 4:
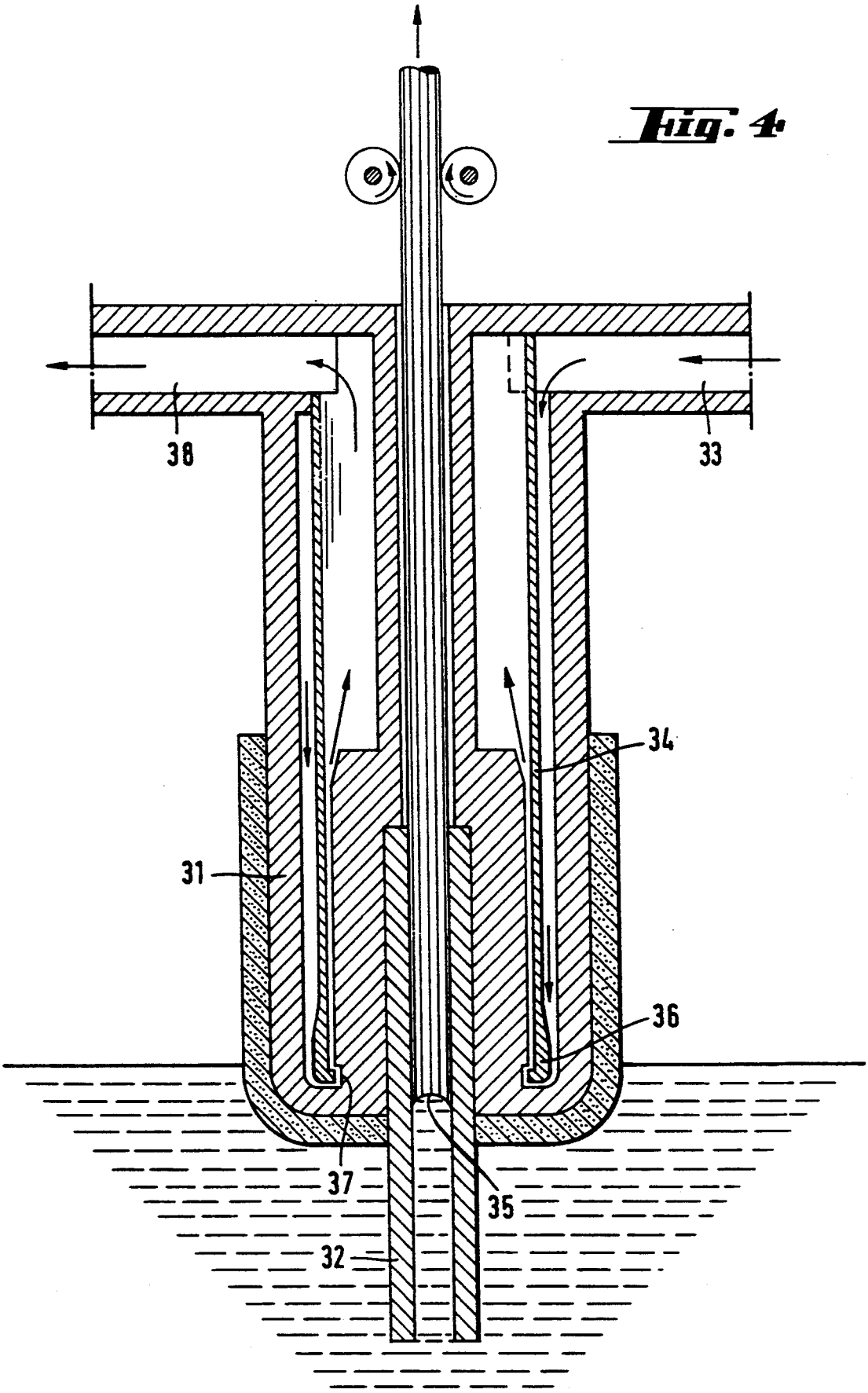
FIG. 4 is a vertical sectional view of a third embodiment of the invention, where the guide member of the cooling agent is located both in the separating member and in the cooler housing.

In the embodiment of FIG. 4, the cooler 31 is installed around the top part of the nozzle 32. The cooling agent is fed in through the inlet 33 provided in the top part of the cooler, and the cooling agent flows in the space between the outer wall of the cooler and the separating member 34 to the bottom part of the cooler 31. In order to direct the cooling agent towards the inner wall of the cooler, there is provided at the bottom part of the separating member 34, essentially at the desired level of the solidification front 35 located in the nozzle 32, at least one guide or aligning member 36, which guides the cooling agent to at least one groove 37 formed in the inner wall of the cooler body in an essentially perpendicular position. Owing to the effect of the guide member 36 and the groove 37, the pressure energy contained in the cooling agent is changed into kinetic energy. Thus the cooling capacity of the cooling agent is improved and at the same time the formation of an insulating steam bed, which would reduce the cooling efficiency, is prevented. The cooling agent heated in the bottom of the cooler, essentially at the hottest point thereof, is discharged from the cooler 31 through the outlet 38 provided in the top part of the cooler.

The above FIGS. 2–4 illustrate preferred embodiments of the invention, each provided with a guide member of a different form, but it is naturally clear that when necessary, these various forms of the guide members can be applied simultaneously in one and the same cooler.

What is claimed is:

1. An apparatus for continuous upward casting of a metal object, comprising:

a nozzle having an upper part, a cooler surrounding the upper part of the nozzle and comprising an outer wall and an inner portion defining a liquid supply passage therebetween, and the inner portion is formed with a plurality of discrete liquid return passages extending substantially parallel to the liquid supply passage and a plurality of discrete guide channels extending substantially perpendicular to the liquid supply passage near the bottom of the cooler and providing communication between the liquid supply passage and the liquid return passages.

2. An apparatus for continuous upward casting of a metal object, comprising:

a nozzle having an upper part, a cooler surrounding the upper part of the nozzle and comprising an outer wall and an inner portion defining a cooling chamber therebetween, for receiving a flow of cooling agent, the outer wall and the inner portion being at a substantially uniform horizontal spacing over a substantial part of the height of the cooling chamber, a separating member disposed in the cooling chamber between the outer wall and the inner portion so that a liquid supply passage is defined between the separating member and the outer wall and a liquid return passage is defined between the separating member and the inner portion, and a guide means near the bottom of the cooler, for influencing flow of cooling agent and intensifying cooling of the metal object near the bottom of the cooler, said guide means being connected to the separatinq member and being configured so that the cross-sectional area of the liquid supply passage decreases in the direction towards the bottom of the cooler over a portion of said substantial part of the height of the cooling chamber, whereby a solidification front is formed in the nozzle between molten metal and solid metal near the bottom of the cooler.

3. Apparatus according to claim 2, wherein the inner portion of the cooler has an outer surface at which it is formed with a groove and the guide means includes an internal ridge extending from the separating member towards the groove, whereby flow of cooling liquid is directed towards the nozzle.

4. Apparatus according to claim 2, wherein the guide means has an outer surface and an inner surface and wherein the outer and inner surfaces of the guide means diverge in a downward direction.

* * * * *